United States Patent [19]

Harris

[11] 4,079,502

[45] Mar. 21, 1978

[54] METHOD OF PRODUCING A STEEL SLAB FROM A BOTTLE-CAP MOLD INGOT

[75] Inventor: James M. Harris, Lutherville, Md.

[73] Assignee: Bethlehem Steel Corporation, Bethlehem, Pa.

[21] Appl. No.: 734,947

[22] Filed: Oct. 22, 1976

[51] Int. Cl.[2] ..... B22D 11/126

[52] U.S. Cl. ..... 29/527.7; 148/128; 148/2; 164/76; 164/107; 75/43; 29/527.6

[58] Field of Search ..... 29/527.6, 527.7; 148/128, 2, 3; 164/76, 55, 56, 57, 107

[56] References Cited

U.S. PATENT DOCUMENTS

| | | | |
|---|---|---|---|
| 2,218,458 | 10/1940 | Wright | 29/527.7 |
| 3,753,288 | 8/1973 | Orbon, Sr. | 29/527.7 |

*Primary Examiner*—C.W. Lanham
*Assistant Examiner*—V. K. Rising
*Attorney, Agent, or Firm*—Joseph J. O'Keefe; John I. Iverson; Robert M. Jones

[57] ABSTRACT

Maximum yield in the production of a slab from a bottle-cap mold ingot is obtained by a method of selecting the ingot mold size.

2 Claims, 2 Drawing Figures

METHOD OF PRODUCING A STEEL SLAB FROM A BOTTLE-CAP MOLD INGOT

BACKGROUND OF THE INVENTION

This invention relates to a method of producing steel slabs. More particularly, it relates to such a method in which the slabs are rolled from a bottle-cap mold ingot.

Slabs of steel are ordered on the basis of metallurgical grade, maximum weight, and specified width. According to the metallurgical grade, the steel is poured either into a bottle-cap ingot mold, which is characterized by a fixed volume, or into either an open-top or a hot-top ingot mold, which has a variable volume.

In the past, bottle-cap ingots were somewhat arbitrarily assigned a maximum providing yield of 96% when rolled into slabs of various widths. This percentage was based upon the maximum yield from the highest yielding ingot size. Thus, to determine the proper size ingot mold for a particular slab, a data base was first searched to obtain the smallest bottle-cap ingot mold in stock that would product as ingot: (1) having one cross-sectional dimension larger than the sum of said specified width plus the width increment reserved for edge work, and (2) a full mold ingot weight greater than the ordered maximum slab weight.

The ordered maximum slab weight was then divided by the maximum providing yield to obtain the required ingot weight. If this weight was about the same as the full mold ingot weight of the ingot mold selected from the data base, this mold was used. If not, the next larger ingot mold was selected.

It has been found that the yield from a bottle-cap ingot varies as much as 8%, depending upon the size of the ingot and the width of the slab. Thus, if ingot sizes other than the highest yielding ingot size were used, the resultant slab was sometimes lighter than the desired weight.

It is an object of the present invention to provide a method of producing a slab of steel from a bottle-cap ingot in which the actual weight of the slab is about equal to the ordered maximum weight of the slab.

SUMMARY OF THE INVENTION

I have discovered that the foregoing object can be obtained by searching a data base, in the same manner as in the prior art, to obtain the smallest bottle-cap ingot mold size in stock that will produce an ingot: (1) having one cross-sectional dimension larger than the sum of the desired slab width plus the width increment reserved for edge work, and (2) a full mold ingot weight greater than the maximum slab weight.

Next, the average providing yield for the width to be rolled from an ingot produced in said smallest ingot mold is obtained from an equation representing the average providing ingot yields for various width slabs rolled from this ingot size. The minimum required ingot weight for this slab is then determined by: (1) determining the estimated maximum providing yield for said width by adding to said average providing yield a number representing the difference between the average providing yield and the maximum providing yield for a bottle-cap ingot produced in said smallest ingot mold, and (2) dividing said maximum slab weight by said maximum providing yield.

The next step in the process comprises comparing the minimum required ingot weight with the full mold ingot weight. If the minimum required ingot weight and the full mold ingot weight are substantially the same, this smallest ingot size is selected. If the minimum required ingot weight and the full mold ingot weight are not the same, the steps beginning with obtaining the average yield are repeated for successively larger ingot sizes until the minimum required ingot weight and the full mold ingot weight are substantially the same.

The selected ingot mold is then filled with molten steel of the ordered metallurgical grade, and the ingot mold is capped. The steel is allowed to solidify into an ingot, and the ingot is then rolled into a slab of the specified width.

DESCRIPTION OF THE PREFERRED EMBODIMENT

As a specific example of the invention, assume that an order for a bottle-cap steel grade is received specifying a maximum slab weight of 21,700 lbs (9,843 Kg) and a slab width of 45 in (114 cm).

Bottle-cap ingots must be reduced by a minimum of 4 in (10.2 cm) to provide the slab with the desired edge characteristics. This reduction, referred to in the art as "edge work", must then be added to the specified slab width to obtain the dimension used to determine the minimum ingot size to be poured.

Table 1 is a data base showing various parameters for bottle-cap ingot molds. Column 1 lists the mold number, and column 2 list the cross-sectional dimensions of each mold. Column 3 lists the full mold ingot weight. Columns 4, 5 and 6 are the coefficients of a parabola, representing average yield, resulting from a regression analysis of empirical data. This equation is:

$$\text{yield} = C_1 + C_2 w + C_3 W^2$$

where $w$ is the width of the slab and the C's are constants.

The last column in Table 1 shows the maximum difference between the maximum and average providing yields.

TABLE 1

| MOLD NO. | MOLD SIZE | INGOT WT. | COEFFICIENTS 1 | 2 | 3 | MAX DIF |
|---|---|---|---|---|---|---|
| 01 | 23×35 | 13,180 | 00.52019700 | 00.02778040 | 00.00055968- | .050 |
| 02 | 25×37 | 15,760 | 00.73629300 | 00.01276480 | 00.00024028- | .050 |
| 03 | 25×44 | 18,170 | 00.47185200 | 00.02435500 | 00.00036706- | .055 |
| 04 | 28×49 | 22,420 | 00.29789800 | 00.03132840 | 00.00040780- | .060 |
| 05 | 26×56 | 23,530 | 00.11830600 | 00.03282920 | 00.00035677- | .050 |
| 06 | 33×55 | 27,270 | 00.13878000- | 00.04423130 | 00.00047334- | .050 |
| 07 | 30×66 | 32,310 | 01.88245000- | 00.09589520 | 00.00083928- | .050 |

As shown in Table 1, ingot mold #4 is the smallest ingot mold having one cross-sectional dimension larger than the sum of slab width plus edge work. The weight of an ingot poured in this mold is disclosed in the table in FIG. 1 as 22,420 lbs (10,170 Kg).

Figure 1:
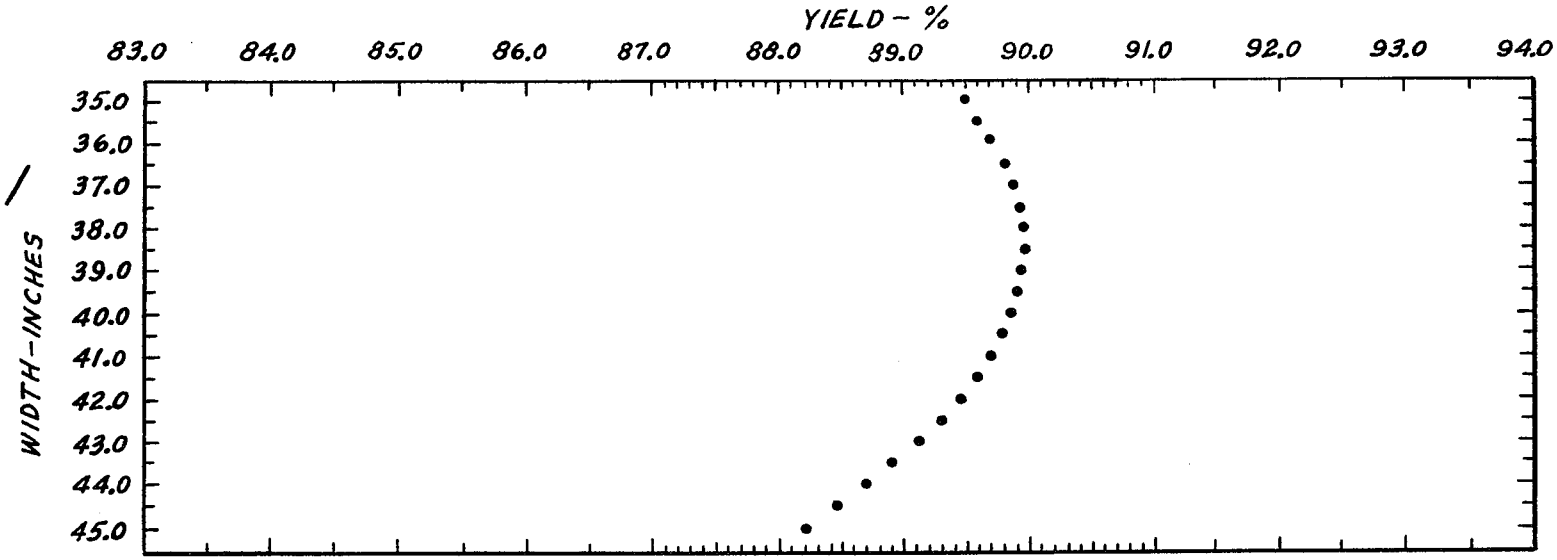
FIGS. 1 and 2 are curves showing the yield as a function of slab width for first and second ingot sizes, respectively.

FIG. 1 is a curve showing average ingot yield as a function of slab width for steel of a certain grade poured in a 28 × 49 in (71.1 × 124.5 cm) mold. As above stated, this curve is a parabola resulting from a regression analysis of empirical data. As can be seen, the yield for a 45 in (114 cm) wide slab is about 88%. To obtain a more accurate figure for yield, Table 2 is consulted. This table lists the coordinates of the curve, viz., average yield as a function of slab width for an ingot poured in mold #4. The yields were calculated from the above equation. The "R-SQUARED" number in the table is the Coefficient of Determination. This coefficient is a value that varis from 0 to 1 and is defined as the proportion of the total variance in the dependent variable that is explained by the independent variable. In other words, "R-SQUARED" is the percentage of the data that is explained by the equation.

TABLE 2

| Ingot Size = 28 × 49<br>Minimum Width = 35 | | | | | | | Maximum Width = 45<br>Width/Yield | | | | |
|---|---|---|---|---|---|---|---|---|---|---|---|
| 35.0 | 35.5 | 36.0 | 36.5 | 37.0 | 37.5 | 38.0 | 38.5 | 39.0 | 39.5 | 40.0 | 40.5 |
| .8948 | .8961 | .8972 | .8981 | .8988 | .8992 | .8995 | .8996 | .8994 | .8991 | .8986 | .8978 |
| 41.0 | 41.5 | 42.0 | 42.5 | 43.0 | 43.5 | 44.0 | 44.5 | 45.0 | | | |
| .8968 | .8957 | .8943 | .8928 | .8910 | .8890 | .8868 | .8845 | .8819 | | | |

$C_1$ = .297898E + 00
$C_2$ = .313284E − 01
$C_3$ = −.407801E − 03
R-SQUARED = .645580

For this width, the yield is 0.8819.

Returning again to Table 1, it is seen that the maximum difference between the average and the maximum providing yield is 0.060 for this ingot size. Thus, the maximum possible yield for this ingot, when rolled into the desired slab width, is 0.8819 + 0.060, or 0.9419.

To obtain the required ingot weight, the desired slab weight is divided by the maximum providing yield.

$$\frac{21{,}700 \text{ lb}}{.9419} (9843 \text{ Kg}) = 23{,}039 \text{ lb } (10{,}450 \text{ Kg})$$

Inasmuch as this required ingot weight is substantially greater than the weight of the ingot poured in mold #4, it is clear that this mold is too small and that mold #5 must be considered. As shown in FIG. 1, the weight of an ingot poured in mold #5 is 23.530 lb (10,673 Kg).

Figure 2:
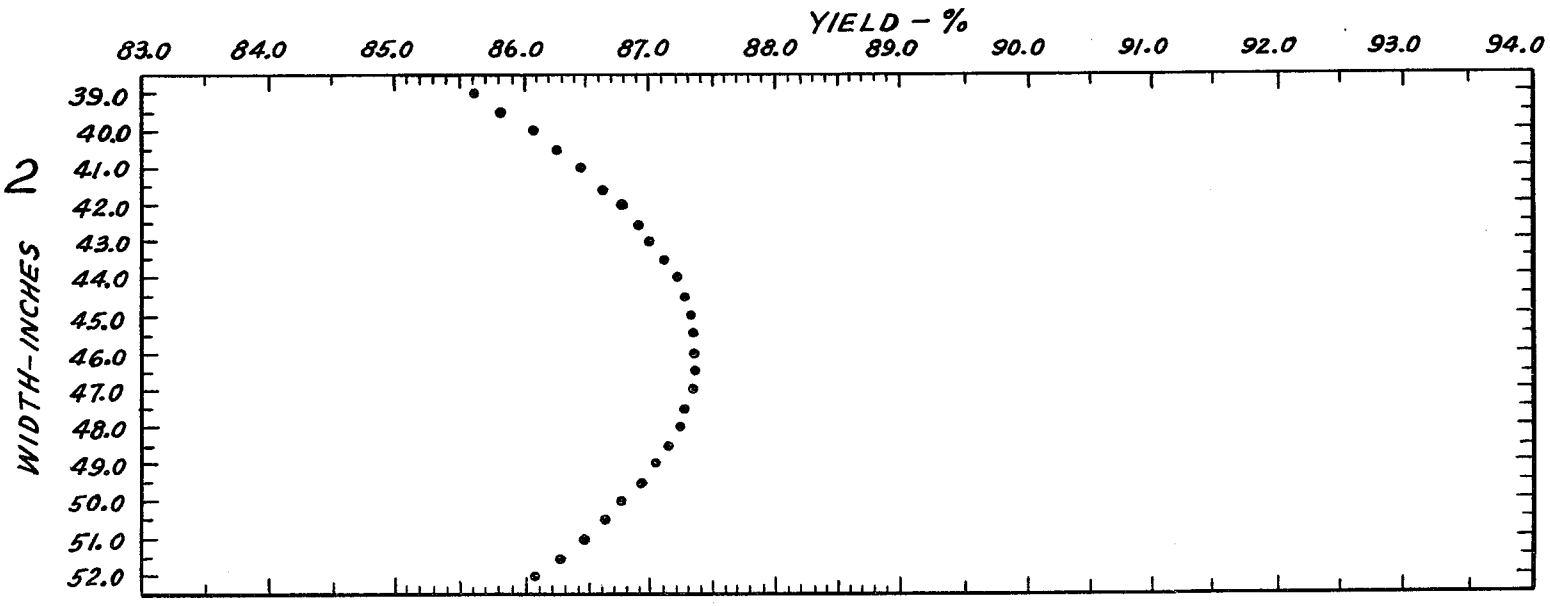

FIG. 2 is a curve showing average providing yield as a function of slab width for an ingot poured in a 26 × 56 in (66.0 × 142 cm) mold. As shown in Table 3 the average yield for a 45.0 l in (114 cm) wide slab is 0.8732. From Table 1, the maximum difference between the average and the maximum yield for this ingot size is 0.050. Thus, the maximum possible yield for this ingot, when rolled into the desired slab width, is 0.8732 × 0.050, or 0.9232.

The desired slab weight is divided by the maximum providing yield to obtain the required ingot weight.

$$\frac{21{,}700 \text{ lb}}{.9232} (9843 \text{ Kg}) = 23{,}505 \text{ lb } (10{,}662 \text{ Kg})$$

Since this ingot weight is in close agreement with the weight of an ingot poured in mold #5, viz., 23,530 lb (10,673 Kg), mold #5 is the correct mold to use for this slab order.

TABLE 3

| Ingot Size = 26 × 56<br>Minimum Width = 39 | | | | | | | Maximum Width = 52<br>Width/Yield | | | | |
|---|---|---|---|---|---|---|---|---|---|---|---|
| 39.0 | 39.5 | 40.0 | 40.5 | 41.0 | 41.5 | 42.0 | 42.5 | 43.0 | 43.5 | 44.0 | 44.5 |
| .8560 | .8584 | .8606 | .8627 | .8646 | .8663 | .8678 | 8691 | .8703 | .8713 | .8721 | .8727 |
| 45.0 | 45.5 | 46.0 | 46.5 | 47.0 | 47.5 | 48.0 | 48.5 | 49.0 | 49.5 | 50.0 | 50.5 |
| .8732 | .8734 | .8735 | .8734 | .8732 | .8727 | .8721 | .8713 | .8703 | .8692 | .8678 | .8663 |
| 51.0 | 51.5 | 52.0 | | | | | | | | | |
| .8646 | .8628 | .8607 | | | | | | | | | |

$A_1$ = .118306E + 00
$A_2$ = .328292E − 01
$A_3$ = −.356773E − 03
R-SQUARED = .590485

Molten steel of the ordered metallurgical grade is then poured into mold #5 until it is full, and the ingot mold is capped. The steel is allowed to solidify into an ingot, and the ingot is then rolled into a slab of the specified width.

I claim:

1. A method of producing, from an ingot made in a bottle-cap ingot mold, a slab of steel of a certain metallurgical grade, a maximum weight, and a specified width, comprising:

(a) searching a data base to obtain the smallest bottle-cap ingot mold size in stock that will produce an ingot;

(1) having one cross-sectional dimension larger than the sum of said specified width plus the width increment reserved for edge work, and (2) a full mold ingot weight greater than the maximum slab weight, (b) obtaining from data, representing the average providing yields for various width slabs rolled from an ingot made in said smallest ingot mold size, the average providing yield for the width to be rolled from this ingot size, (c) determining the minimum required ingot weight for said slab by:

(1) determining the estimated maximum providing yield for said width by adding to said average providing yield a number representing the difference between the average providing yield and the maximum providing yield for a bottle-cap ingot produced in said smallest ingot mold, and (2) dividing said maximum slab weight by said maximum providing yield, (d) comparing said minimum required ingot weight with said full mold ingot weight, and:

(1) if said minimum required ingot weight and said full mold ingot weight are substantially the same, selecting said smallest ingot size, and (2) if said minimum required ingot weight and said full mold ingot weight are not substantially the same, repeating steps (b), (c), and (d) for successively larger ingot sizes until said minimum required ingot weight and said full mold ingot weight are substantially the same, (e) filling the selected ingot mold with molten steel of said metallurgical grade and capping said ingot mold, (f) allowing the steel in said mold to solidify into an ingot, and (g) rolling said ingot into a slab of said specified width.

2. A method as recited in claim 1, in which the average providing yields in step (b) are represented by a parabola regression equation obtained from empirical data.

* * * * *